US007604326B2

(12) United States Patent
Nishio et al.

(10) Patent No.: US 7,604,326 B2
(45) Date of Patent: Oct. 20, 2009

(54) ELECTROSTATIC SUCTION TYPE FLUID DISCHARGE DEVICE

(75) Inventors: Shigeru Nishio, Yamatokoriyama (JP); Hironobu Iwashita, Chiyoda-ku (JP); Kazunori Yamamoto, Chiyoda-ku (JP); Kazuhiro Murata, Tokyo (JP)

(73) Assignees: Sharp Kabushiki Kaisha, Osaka (JP); Konica Minolta Holdings, Inc., Tokyo (JP); National Institute of Advanced Industrial Science and Technology, Tokyo (JP)

( * ) Notice: Subject to any disclaimer, the term of this patent is extended or adjusted under 35 U.S.C. 154(b) by 454 days.

(21) Appl. No.: 10/567,874

(22) PCT Filed: Aug. 4, 2004

(86) PCT No.: PCT/JP2004/011168

§ 371 (c)(1),
(2), (4) Date: Feb. 8, 2006

(87) PCT Pub. No.: WO2005/014291

PCT Pub. Date: Feb. 17, 2005

(65) Prior Publication Data

US 2008/0151006 A1 Jun. 26, 2008

(30) Foreign Application Priority Data

Aug. 8, 2003 (JP) ..... 2003-206961

(51) Int. Cl.
*B41J 2/06* (2006.01)
*B41J 2/04* (2006.01)
*B05B 5/00* (2006.01)
*B05B 5/025* (2006.01)

(52) U.S. Cl. ..... 347/55; 347/54; 239/690; 239/706; 239/3

(58) Field of Classification Search ..... 347/55, 347/54, 5, 20, 68; 239/3, 4, 102.2, 690–708, 239/533.1, 589
See application file for complete search history.

(56) References Cited

U.S. PATENT DOCUMENTS 5,442,384 A * 8/1995 Schantz et al. ..... 347/20

(Continued)

FOREIGN PATENT DOCUMENTS

JP 36-13768 8/1961

(Continued)

OTHER PUBLICATIONS

Koichi Saito, "*Theory of the Electrostatic Suction Type Slit Jet*", Electronic Imaging & Devices Research Laboratory, Fuji Xerox Co. Ltd., vol. 17-4, (1988), pp. 185-193.
Penny J. Birdseye, et al. "*The Electric Field and The Stress On A Field-ion Specimen*", Surface Science 23, (1970), pp. 198-210, North-Holland Publishing Co.

*Primary Examiner*—Stephen D Meier
*Assistant Examiner*—Rene Garcia, Jr.
(74) *Attorney, Agent, or Firm*—Edwards Angell Palmer & Dodge LLP; David G. Conlin; David A. Tucker

(57) ABSTRACT

With a micro nozzle in which the fluid discharge head has a nozzle with a micro hole having a diameter of 0.01 μm to 25 μm, the drive voltage during discharging operation is reduced. Further, by disposing an electrode section for applying a drive voltage to a discharge fluid on an external wall of a nozzle section, a distance between the electrode section and the nozzle hole is shortened. With this structure, the subject invention achieves both miniaturization of nozzle and reduction in drive voltage in an electrostatic suction type fluid discharge device. The subject invention also achieves an increase in discharge limit frequency while allowing use of materials with higher resistance for the fluid to be discharged.

2 Claims, 11 Drawing Sheets

U.S. PATENT DOCUMENTS

| | | | | |
|---|---|---|---|---|
| 6,328,426 | B1 | 12/2001 | Chahn et al. | |
| 6,474,573 | B1 * | 11/2002 | Kelly | 239/690 |
| 7,264,337 | B2 * | 9/2007 | Lee et al. | 347/55 |
| 7,314,185 | B2 * | 1/2008 | Nishi et al. | 239/102.1 |
| 7,337,987 | B2 * | 3/2008 | Nishi et al. | 239/102.1 |
| 2003/0015594 | A1 * | 1/2003 | Kelly | 239/3 |

FOREIGN PATENT DOCUMENTS

| | | | |
|---|---|---|---|
| JP | 01101158 A | * | 4/1989 |
| JP | 01110964 A | * | 4/1989 |
| JP | 01-200965 | | 8/1989 |
| JP | 08-238774 | | 9/1996 |
| JP | 09-193400 | | 7/1997 |
| JP | 2000-127410 | | 5/2000 |
| JP | 2001-088306 | | 4/2001 |
| JP | 2001-130028 | | 5/2001 |
| JP | 2002-172786 | | 6/2002 |
| JP | 2002172786 A | * | 6/2002 |

* cited by examiner

ELECTROSTATIC SUCTION TYPE FLUID DISCHARGE DEVICE

TECHNICAL FIELD

The present invention relates to an electrostatic suction type fluid discharge device, which discharges by electrostatic suction a charged conductive fluid such as ink, onto an object.

BACKGROUND ART

Typical examples of fluid jet methods for discharging a fluid such as ink onto an object (recording medium) are a piezo type and a thermal type that are commercially utilized in ink jet printers. In addition to them, there is an electrostatic suction type which is arranged as follows: the fluid to be discharged has electrical conductivity, and an electric field is applied to the conductive fluid so that the fluid is discharged through a nozzle.

Such an electrostatic suction type fluid discharge device is disclosed in, for example, Japanese Examined Patent Publication 36-13768 (published on Aug. 18, 1961) and Japanese Laid-Open Patent Application No. 2001-88306 (published on Apr. 3, 2001).

Also, Japanese Laid-Open Patent Application No. 2000-127410 (published on May 9, 2000) discloses an inkjet device arranged such that a nozzle hole is slit-shaped and a protruding needle electrode is formed on the nozzle hole, and an ink including fine particles is discharged using the needle electrode. Japanese Laid-Open Patent Application No. 8-238774 (published on Sep. 17, 1996) discloses an inkjet device including an electrode for applying a voltage inside the nozzle.

The following describes a fluid discharge model in a conventional electrostatic suction type fluid discharge device.

Design factors of electrostatic suction type fluid discharge devices, especially of on-demand electrostatic suction type fluid discharge devices are, conductivity of an ink fluid (e.g. specific resistance of $10^6$ Ω cm to $10^{11}$ Ω cm), surface tension (e.g. 0.020 N/m to 0.040 N/m), viscosity (e.g. 0.011 to 0.015 Pa·s), and applied voltage (electric field). As to the applied voltage, it has been considered that the voltage applied to the nozzle and between the nozzle and an opposing electrode are particularly important.

The electrostatic suction type fluid discharge devices utilize electrofluid instability, as shown in FIG. 15. Placing a conductive fluid in a uniform electric field, an electrostatic force exerted on the surface of the conductive fluid causes the surface to be instable, thereby precipitating the development of a thread (electrostatic thread-forming phenomenon). The electric field on this occasion is defined as $E_0$ which is generated when a voltage V is applied between a nozzle and an opposing electrode. The distance between the nozzle and the opposing electrode is defined as h. A development wavelength $\lambda_c$ in the aforesaid case can be physically figured out (see, e.g. The Institute of Image Electronics Engineers of Japan, Vol. 17, No. 4, 1988, pp. 185-193), and the developing wavelength $\lambda_c$ is represented by the following equation:

$$\lambda_c = \frac{2\pi\gamma}{\varepsilon_0} E_0^{-2} \tag{1}$$

In the equation, γ is surface tension (N/m), $\in_0$ is dielectric constant (F/m) in a vacuum, and $E_0$ is electric field intensity (V/m). If the nozzle diameter d(m) is shorter than $\lambda_c$, the development does not occur. That is, the condition of the discharging is defined as follows.

$$d > \frac{\lambda_c}{2} = \frac{\pi\gamma}{\varepsilon_0 E_0^2} \tag{2}$$

Provided that $E_0$ is an electric field intensity (V/m) on the assumption that a parallel flat plate is adopted, h(m) is the distance between the nozzle and opposing electrode, and $V_0$ is a voltage applied to the nozzle, the following equation is given:

$$E_0 = \frac{V_0}{h} \tag{3}$$

Therefore, the following formula is also given:

$$d > \frac{\pi\gamma h^2}{\varepsilon_0 V_0^2} \tag{4}$$

The fluid discharge devices have typically been required to reduce the diameter of the nozzle through which ink is discharged, in order to form finer dots and lines.

However, in the currently-used piezo or thermal fluid discharge devices, it is difficult to reduce the nozzle diameter and discharge, for example, a very small amount of fluid less than 1 pl. This is because, the smaller the nozzle for discharging a fluid is, the more the pressure necessary for the discharge increases.

In addition to the above, in the aforesaid fluid discharge devices, achieving micro droplets contradicts with attaining high accuracy, and hence it has been difficult to realize both of these improvements at the same time. The reason of this will be described below.

Kinetic energy imparted to the droplet discharged from the nozzle is in proportion to the cube of the diameter of the droplet. Therefore, the micro droplets discharged from a micro nozzle cannot attain the kinetic energy sufficient to resist the air resistance at the time of the discharge, and the droplets are disturbed by accumulated air or the like. For this reason, it is not possible to expect accurate landing of the droplets. Moreover, since the effect of the surface tension increases as the size of the droplets decreases, the vapor pressure of the droplets increases and an amount of evaporation increases. As a result, a great amount of each micro droplet gets lost while flying, and it is difficult to retain the form of each droplet at the time of landing.

In addition to the above, according to the aforesaid fluid discharge model of the conventional electrostatic suction type fluid discharge devices, the reduction in the nozzle diameter demands the increase in the electric field intensity, which is necessary for the discharge, as the above-described equation (2) shows. The electric field intensity is, as shown in the equation (3), determined by the voltage (drive voltage) $V_0$ applied to the nozzle and the distance h between the nozzle and opposing electrode. Therefore, the reduction in the nozzle diameter results in the increase in the drive voltage.

The drive voltage in the conventional electrostatic suction type fluid discharge devices is very high (not less than 1000V). It is therefore difficult to achieve the reduction in size and the density growth, in consideration of leaks and interferences between the nozzles. Also, the problem becomes serious as the nozzle diameter is further reduced. A power semiconductor with a high voltage of not less than 1000V is typically expensive and does not excel in frequency response.

In the Japanese Examined Patent Publication 36-13768, the nozzle diameter is 0.127 mm. The range of the nozzle diameter in Japanese Laid-Open Patent Application No. 2001-88306 is 50 μm to 2000 μm, more preferably 100 μm to 1000 μm.

As to the nozzle diameter, the development wavelength $\lambda_c$ is worked out as follows, if typical operating conditions of the conventional electrostatic suction type fluid discharge are applied: the development wavelength $\lambda_c$ is about 140 μm where the surface tension is 0.020 N/m and the electric field intensity is $10^7$ V/m in the aforesaid equation (1). Consequently, the limit nozzle diameter is 70 μm. It has therefore been considered that, in a case where the nozzle diameter is not more than about 70 μm in the aforesaid conditions, the ink development does not occur even if the field intensity is high ($10^7$ V/m), unless a countermeasure such as forcible formation of meniscus by the application of a back pressure is carried out. In short, it has been considered that miniaturization of the nozzle and reduction in the drive voltage are not compatible.

As described above, in the conventional fluid discharge devices, miniaturization of the nozzle contradicts with high accuracy, and it has been difficult to achieve both of these improvements. In particular, regarding the electrostatic suction type fluid discharge devices, it has been considered that miniaturization of the nozzle contradicts with the reduction in the drive voltage.

DISCLOSURE OF INVENTION

The present invention is made to solve the foregoing problems, and an object of the present invention is to provide an electrostatic suction type fluid discharge device which realizes miniaturization of a nozzle, discharge of a extremely slight amount of fluid and high positional accuracy of its landing, and reduction in drive voltage.

To attain the foregoing object, an electrostatic suction type fluid discharge device of the present invention discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the electrostatic suction type fluid discharge device including an electrode section for carrying out application of a driving voltage, causing an electric charge to be supplied to the discharge fluid, so as to charge the discharge fluid, the electrode section being formed by coating an external wall of the nozzle with a conductive material.

According to the above arrangement, with the nozzle having the fluid discharge hole with a micro diameter (nozzle diameter) ranging from 0.01 μm to 25 μm, a local electric field occurs. This allows reduction in the drive voltage during discharging operation. The reduction in the drive voltage will be a great advantage for realizing downsizing of the device and for high density configuration of the nozzles. Further, the reduction in the drive voltage allows use of a low-voltage driven driver with merit in view of cost.

Further, the above discharge model does not require an opposing electrode because an electric field intensity necessary for discharging varies depending on the local converged electric field intensity. That is, the above discharge model enables printing to an insulating substrate or the like without employing an opposing electrode, thereby allowing for more flexibility in the configuration of the device. Further, printing to a thick insulator becomes also possible.

In a structure in which a drive electrode is provided inside the fluid flow path in the micro nozzle, it is difficult to bring the drive electrode closer to the nozzle hole. In this case, an electric resistance between the drive electrode and the tip of the nozzle inside the fluid discharge head increases. As a result, a discharge response is degraded.

On the contrary, in the electrostatic suction type fluid discharge device, the electrode section, which applies the drive voltage to charge the discharge fluid, is provided by coating the external wall of the nozzle with a conductive material. This facilitates construction of the head in which a distance between the electrode section and the nozzle hole is minimally shortened. That is, by bringing the electrode section closer to the nozzle hole, a drive frequency for causing discharge increases. Further, it allows use of materials with higher resistance for the fluid to be discharged.

Further, in the electrostatic suction type fluid discharge device, it is preferable that the electrode section constitutes at least a part of inner wall of the nozzle.

According to the above arrangement, the electrode section constitutes at least a part of the inner wall of the nozzle. Therefore, regardless of whether or not the discharge fluid is being discharged, the electrode section is in touch with the fluid in the nozzle. Thus, when the drive voltage is applied to the electrode section, an electric charge is instantly supplied to the discharge fluid, so that the discharge response is improved.

To attain the foregoing object, an electrostatic suction type fluid discharge device according to the present invention discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the nozzle having a tip made of a conductive material, the tip serving as an electrode section for applying a drive voltage to electrically charge the discharge fluid.

According to the above arrangement, the tip of the nozzle itself is made of a conductive material, and the tip portion serves as the electrode section to supply an electric charge to the discharge fluid inside the nozzle. This makes it possible to charge the fluid in the vicinity of the nozzle hole which is discharged at the beginning of discharge, and also to charge the fluid inside the fluid flow path away from the nozzle hole. This improves both the discharge response and the durability of the electric charge during consecutive discharging, i.e., stability in a consecutive discharging.

Further, the electrostatic suction type fluid discharge device may include pressure applying means for applying a pressure into the nozzle.

According to the above arrangement, the pressure applying means applies a guiding pressure to the discharge fluid inside the nozzle, thereby keeping the discharge fluid to be guided to the outside of the nozzle hole. Therefore, during the fluid discharging operation, the discharge fluid is charged by the electrode section at the same timing of voltage application to the electrode section. Thus, stable discharge is realized.

To attain the foregoing object, an electrostatic suction type fluid discharge device according to the present invention discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the electrostatic suction type fluid discharge device including an electrode section provided inside the nozzle, the electrode section for carrying out application of a driving voltage, causing an electric charge to be supplied to the discharge fluid, so as to charge the discharge fluid, an inner wall of a tip of the nozzle has a taper section with a taper angle θ of 21° or greater, provided that L/d>5, where L is a taper length and d is a nozzle diameter.

According to the above arrangement, the electric resistance between the electrode section and the nozzle hole is significantly suppressed by forming the taper section on the inner wall of the tip of the nozzle, and setting the taper angle to be 21° or greater. This improves a discharge limit frequency. Further, it allows use of materials with higher resistance for the fluid to be discharged.

To attain the foregoing object, an electrostatic suction type fluid discharge device according to the present invention discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the electrostatic suction type fluid discharge device including an electrode section provided inside the nozzle, the electrode section for carrying out application of a driving voltage, causing an electric charge to be supplied to the discharge fluid, so as to charge the discharge fluid, an inner wall of a tip of the nozzle having a taper section with a taper angle q satisfying a condition: θ>58×d/L, where L is a taper length and d is a nozzle diameter, provided that L/d<100.

According to the above arrangement, the electric resistance between the electric section and the nozzle hole is significantly suppressed by forming the taper section on the inner wall of the tip of the nozzle, and setting its taper angle to satisfy θ>58×d/L. This improves a discharge limit frequency. Further, it allows use of materials with higher resistance for the fluid to be discharged.

Further, in the electrostatic suction type fluid discharge device, the electrode section may be formed as a bar inserted into the nozzle and a tip of the electrode section may be in contact with the inner wall of the taper section.

According to the above arrangement, an electric resistance of the discharge fluid in the flow path between the electrode section and the nozzle hole is reduced because the electrode section is brought to the closest point to the nozzle up to the vicinity of the nozzle. This improves a discharge limit frequency. Further, it allows use of materials with higher resistance for the fluid to be discharged.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

BEST MODE FOR CARRYING OUT THE INVENTION

With reference to figures, one embodiment of the present invention is described below.

An electrostatic suction type fluid discharge device of the present embodiment has a nozzle having a diameter ranging from 0.01 μm to 25 μm, and enables discharge control of a discharge fluid with a drive voltage of 1000V or lower.

In a conventional fluid discharge model, it has been assumed that fluid discharge with a drive voltage of 1000V or lower is impossible when a nozzle has a diameter ranging from 50 μm to 70 μm or below, without taking another measure such as application of back pressure to a discharge fluid. This is because reduction in nozzle diameter causes an increase in drive voltage. However, inventors of the present invention have devoted themselves to reviewing, and found that a nozzle having a specific diameter or less causes a discharge phenomenon in a discharge model which differs from the conventional fluid discharge model. The present invention is made based on such new finding regarding the fluid discharge model.

The following describes a fluid discharge model which is a premise technique of the present invention having the basis on the above finding.

Figure 2:
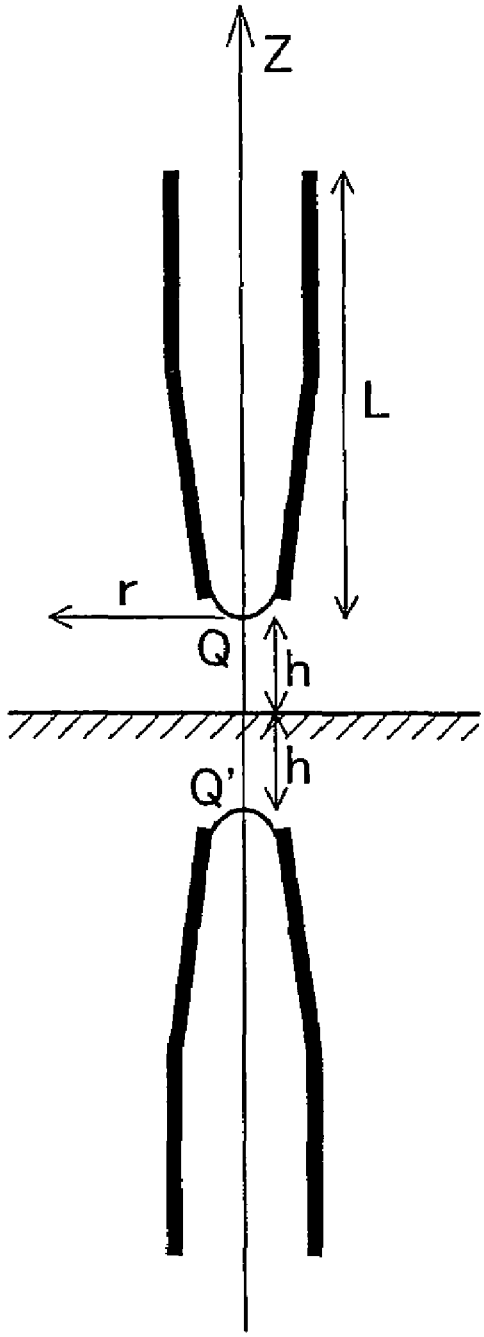
FIG. 2 is a drawing for showing calculation of electric field intensity in a basic discharge model of the present invention.

Assume that an electrically conductive fluid is injected into a nozzle having a diameter d (hereinafter d indicates an internal diameter of the nozzle unless otherwise noted), and that the nozzle is positioned at a height of h from an infinite flat plate conductor, as illustrated in FIG. 2. Here, it is assumed that an electric charge Q, induced at the tip of the nozzle, is converged to a hemispherical portion formed by the discharge fluid at the tip of the nozzle. The Q is approximately expressed by the following equation (5):

$$Q=2\pi\in_0\alpha V_0 d \tag{5}$$

where Q is the electric charge (C) induced at the tip of the nozzle, $\in_0$ is the dielectric constant (F/m) of a vacuum, d is the diameter (m) of the nozzle, and $V_0$ is the total voltage applied to the nozzle. Further, $\alpha$ is a proportionality constant, which varies depending on the shape of the nozzle and other factors, and takes a value of approximately 1 to 1.5. Specifically, $\alpha$ approaches 1 when the following inequality is satisfied, $$D<<h$$

where h is the distance (m) between the nozzle and a substrate.

Further, when a conducting substrate is used as the substrate, it would appear that a mirror image charge Q' is induced at a position symmetrical and opposed to the nozzle, in the substrate. The mirror image Q' has an opposite polarity to that of the charge Q. Similarly, when the substrate is an insulator, a image charge Q' having an opposite polarity to that of the charge Q is induced at a position which is determined according to the dielectric constant of the substrate.

Assuming that R is a radius of curvature at the tip of the nozzle, a converged electric field intensity $E_{loc}$ at the tip is given by the following equation (6):

$$E_{loc} = \frac{V_0}{kR} \tag{6}$$

where k is the proportionality constant, which varies depending on the shape of the nozzle etc., and takes a value of approximately 1.5 to 8.5. It would appear that k takes approximately 5 in many cases (P. J. Birdseye and D. A. Smith, Surface Science, 23 (1970), p. 198-210). Here, it is assumed that R is d/2 in order to simplify the fluid discharge model. This corresponds to a state in which a surface tension at the tip of the nozzle causes a conductive ink to have a hemispherical shape whose curvature radius is identical to that of the nozzle diameter d.

Here, consider a balance of pressures exerted on the discharge fluid at the tip of the nozzle. When assuming that an area of the liquid at the tip of the nozzle is indicated by S, an electrostatic pressure $P_e$ is given by the following equation (7):

$$P_e = \frac{Q}{S}E_{loc} = \frac{2Q}{\pi d^2}E_{loc} \tag{7}$$

Based on the equations (5) through (7), when $\alpha$ is equal to 1, $P_e$ is expressed by the following equation (8):

$$P_e = \frac{4\varepsilon_0 V_0}{d}\cdot\frac{2V_0}{kd} = \frac{8\varepsilon_0 V_0^2}{kd^2} \tag{8}$$

On the other hand, a surface tension $P_s$ of the discharge fluid at the tip of the nozzle is given by the following equation (9):

$$P_s = \frac{4\gamma}{d} \tag{9}$$

where $\gamma$ is the surface tension. Since electrostatic pressure causes discharge under a condition where the electrostatic pressure exceeds the surface tension, the following inequality (10) is given:

$$P_e>P_s \tag{10}$$

Figure 3:
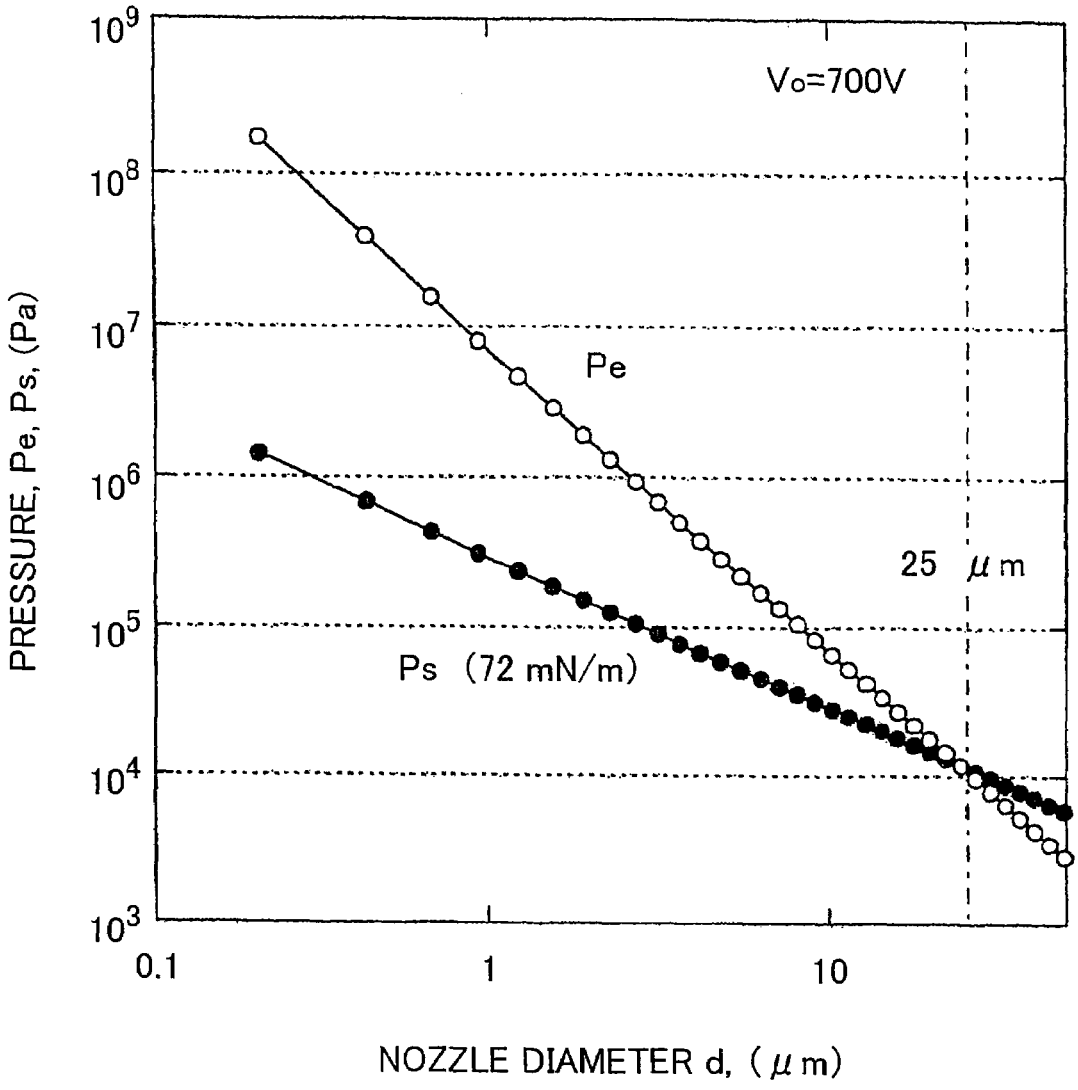
FIG. 3 is a graph showing a result of model calculation for nozzle diameter dependencies of surface tension pressure and electrostatic pressure.

FIG. 3 shows a relationship between a pressure caused by the surface tension and an electrostatic pressure, when the nozzle has a diameter d. As to the surface tension, the discharge fluid is assumed to be water ($\gamma$=72 mN/m). According to FIG. 3, on the stipulation that a voltage of 700V is applied to the nozzle, the electrostatic pressure appears to exceed the surface tension when the nozzle has a diameter d of 25 μm. This causes $V_0$ and d to have a relation therebetween expressed by the following inequality (11), which gives a minimum voltage for discharging:

$$V_0 > \sqrt{\frac{\gamma kd}{2\varepsilon_0}} \tag{11}$$

Further, a discharge pressure $\Delta P$ can be found by the following equation (12), and is finally given by the following equations (13):

$$\Delta P = P_e - P_s \tag{12}$$

$$\Delta P = \frac{8\varepsilon_0 V_0^2}{kd^2} - \frac{4\gamma}{d} \tag{13}$$

Figure 4:
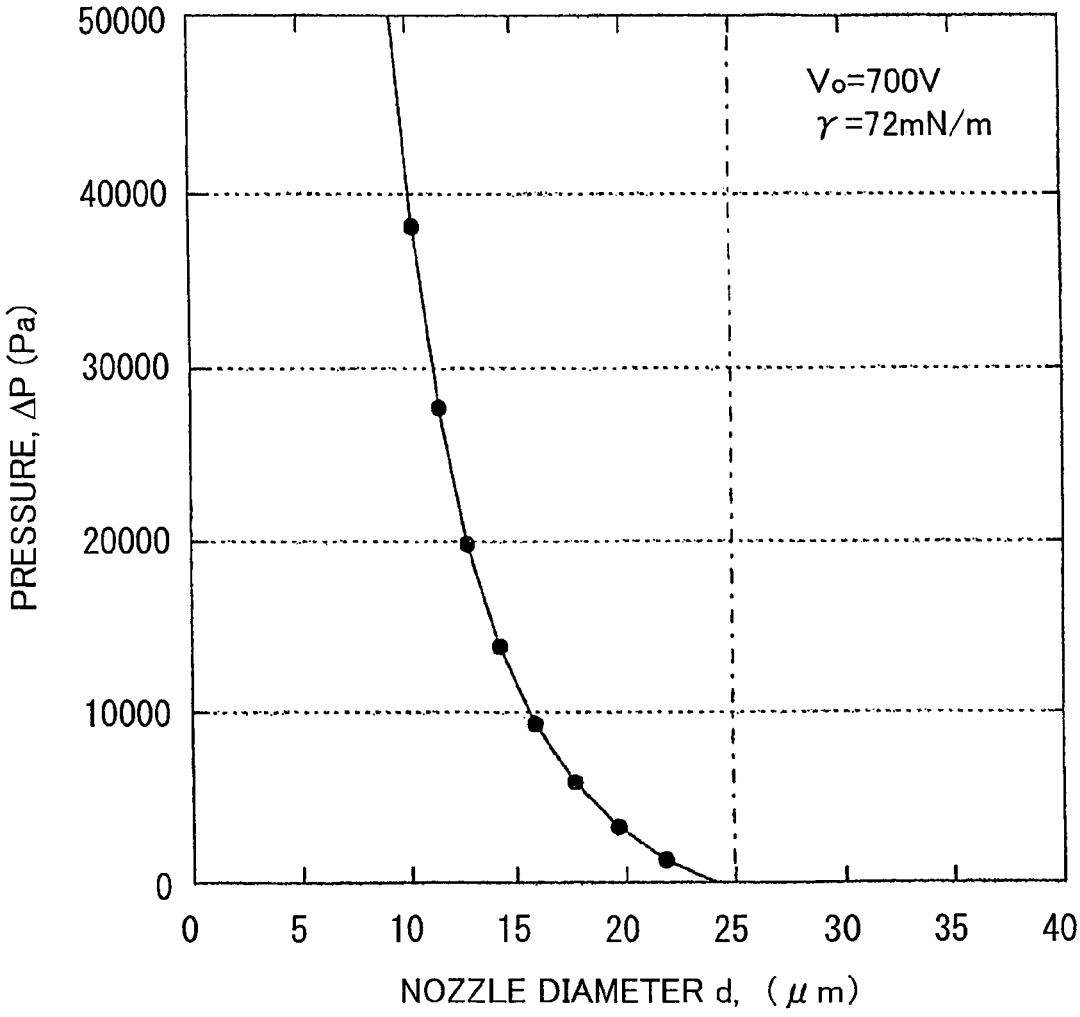
FIG. 4 is a graph showing a result of a model calculation for nozzle diameter dependency of discharge pressure.

FIG. 4 shows a dependency of the discharge pressure $\Delta P$ on the nozzle having a diameter d when a local electric field intensity satisfies a condition for discharging. Further, FIG. 5 shows a dependency of a discharge critical voltage (i.e., a minimum voltage causing a discharge) Vc on the nozzle having a diameter d.

FIG. 4 shows that, when the local electric field satisfies the condition for discharging (when it is assumed that $V_0$ is 700V and $\gamma$ is 72 mN/m), an upper limit of the nozzle diameter is 25 μm.

Figure 5:
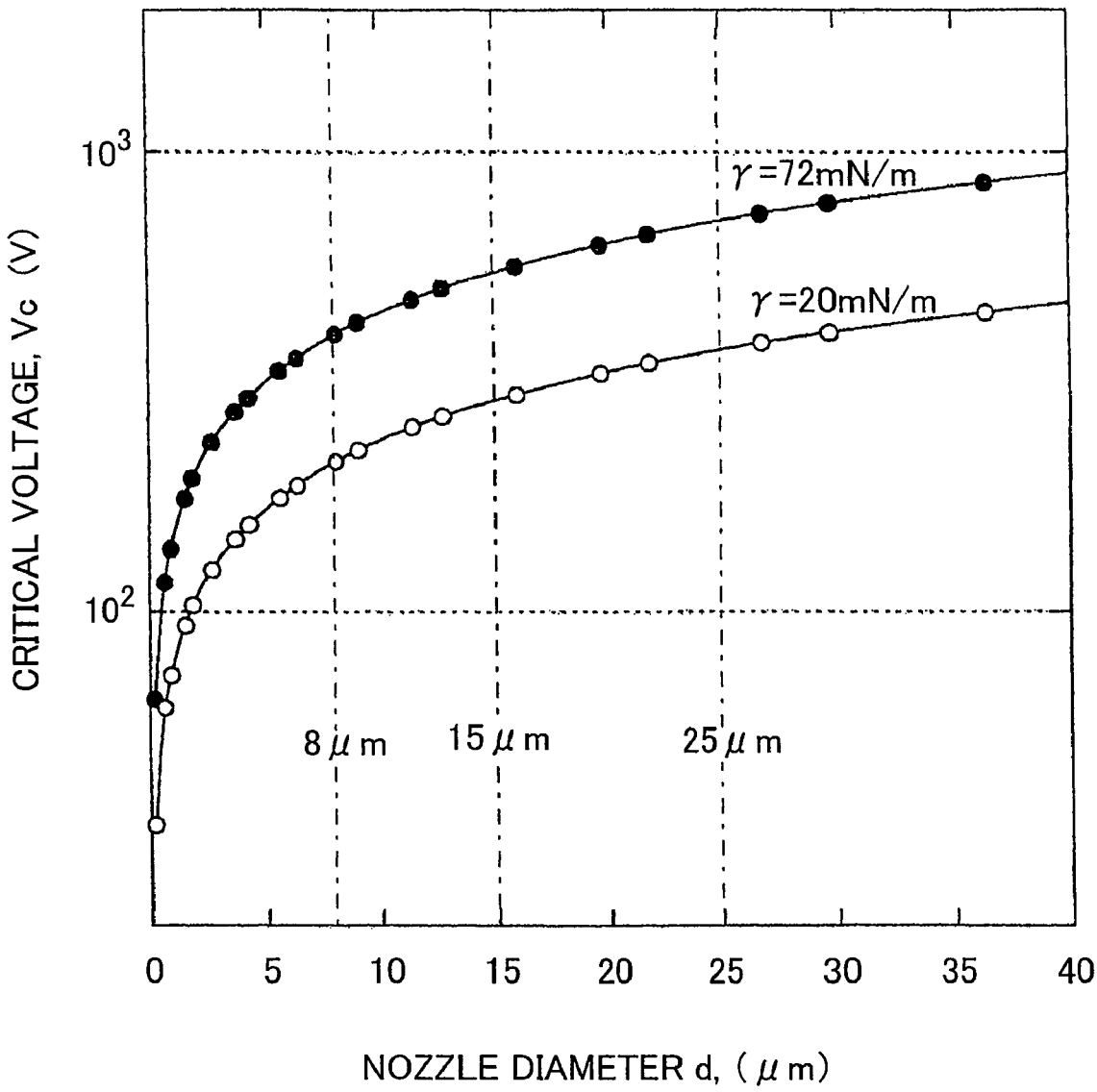
FIG. 5 is a graph showing a result of model calculation for nozzle diameter dependency of discharge limit voltage.

In FIG. 5, calculations are performed under the conditions that discharge fluids are water ($\gamma$=72 mN/m) and an organic solvent ($\gamma$=20 mN/m), and k is 5. In consideration of such an effect that the micro nozzle causes an electric field to be converged, it is clear from FIG. 5 that the discharge critical voltage Vc decreases as the nozzle diameter decreases. FIG. 5 shows that, when the discharge fluid is water and the nozzle diameter is 25 μm, the discharge critical voltage Vc is approximately 700V.

In cases where a conventional approach is taken regarding the electric field in the discharge model i.e., in cases where only an electric field defined by (i) a voltage $V_0$ applied to the nozzle and (ii) a distance h between the nozzle and an opposing electrode is taken into account, a drive voltage necessary for discharging increases as the nozzle diameter decreases to a micro size.

In contrast, as shown in the new discharge model proposed in the premise technique, by taking account of the local electric field intensity, a microscopic nozzle size allows a reduction in the drive voltage. The reduction in the drive voltage will be a great advantage for realizing downsizing of the device and for high density configuration of the nozzles. Further, the reduction in the drive voltage certainly allows use of a low voltage driver with merit in view of cost.

Further, the above discharge model does not require an opposing electrode because the electric field intensity necessary for discharging varies depending on the local converged electric field intensity. That is, as to an insulating substrate, the conventional discharge model has required an opposing electrode to be disposed on the opposite side of the nozzle relative to the nozzle, in order to apply an electric field between the nozzle and the substrate. Alternatively, the conventional discharge model has required a substrate to be conductive. When the opposing electrode is disposed (i.e., when the substrate is an insulator), there has been a limitation to the thickness of the applicable substrate.

On the other hand, the discharge model of the present invention enables printing to an insulating substrate or the like without employing an opposing electrode, thereby allowing for more flexibility in the configuration of the device. Further, printing to a thick insulator becomes also possible.

As described above, the electrostatic suction type fluid discharge device of the present embodiment employs the newly proposed discharge model, which takes account of the local electric field intensity. This allows the nozzle to be micro size of 0.01 μm to 25 μm, and also allows a drive voltage of 1000V or lower to carry out a discharge control of the fluid. As a result of considerations using the above model, it is found that a drive voltage of 700V or lower can carry out the discharge control for a nozzle having a diameter of 25 μm or smaller, a drive voltage of 500V or lower for a nozzle having a diameter of 10 μm or smaller, and a drive voltage of 300V or lower for a nozzle having a diameter of 1 μm or smaller.

Figure 6:
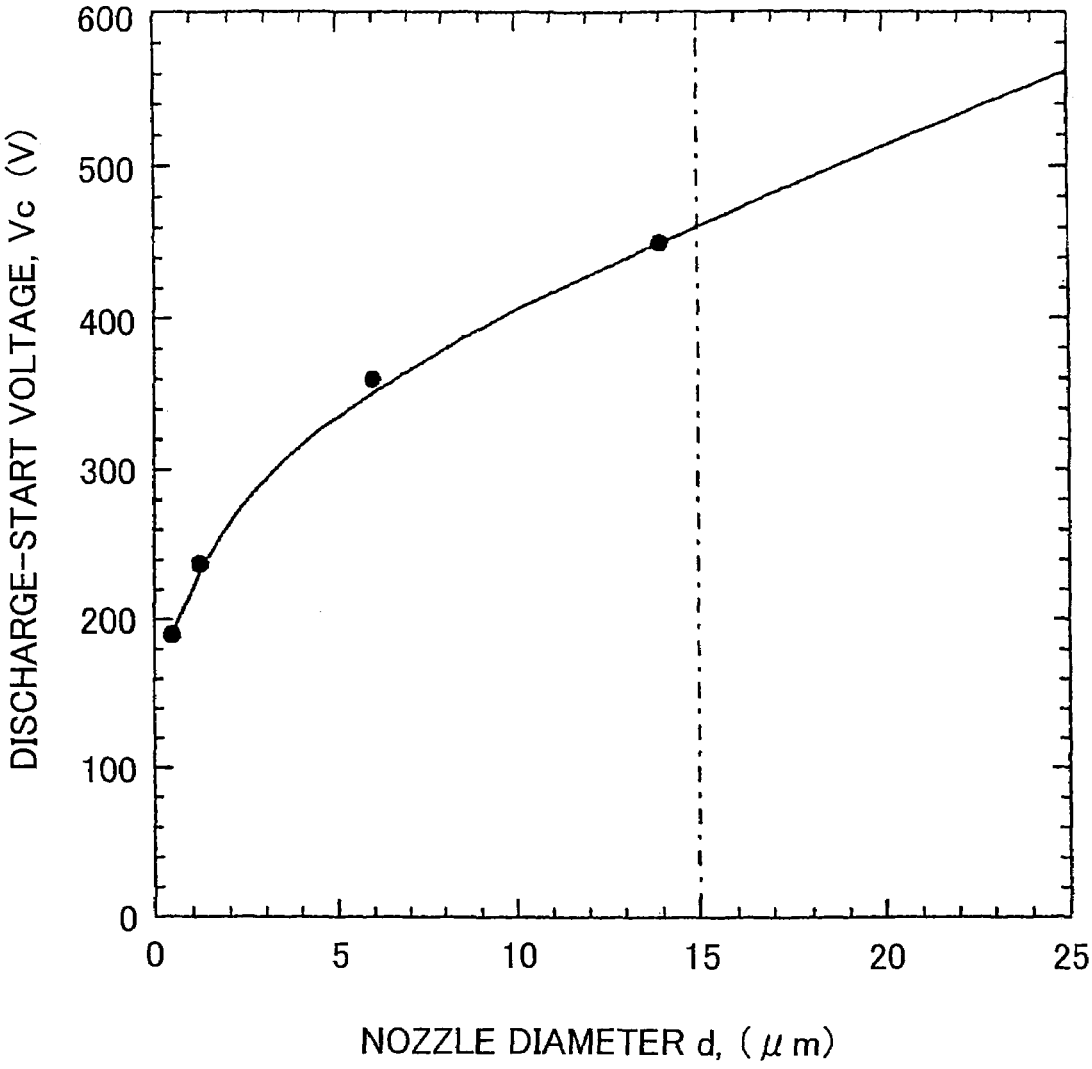
FIG. 6 is a graph showing a result of an experiment for examining a nozzle diameter dependency of discharge-start voltage.

FIG. 6 shows a result experimentally obtained with regard to a dependency of the nozzle on the discharge critical voltage Vc. The measurement was carried out using silver Nano paste made by Harima chemical Inc. under the condition that the distance between the nozzle and the substrate is 100 μm. FIG. 6 shows, as the nozzle decreases in size, the discharge critical voltage Vc decreases. This allows for the discharge with a lower voltage than the voltage necessary for discharging in the conventional model.

As described above, an electrostatic suction type fluid discharge device of the present embodiment allows reduction both in the nozzle diameter and in the drive voltage, and has outstanding problems described below as compared to a conventional electrostatic suction type fluid discharge device.

In the aforementioned electrostatic suction type fluid discharge device, its discharge characteristic is determined depending on an electric resistance, in a flow path for the discharge fluid (hereinafter simply referred to as "discharge-fluid flow path"), from the drive electrode to the tip of the nozzle in a fluid discharge head. The lower the electric resistance is, the more a discharge response improves. That is, a reduction in the electric resistance in the discharge-fluid flow path improves a drive frequency. This further enables discharging of a discharge fluid material having a higher resistance, thereby enlarging selections of discharge fluid materials.

The reduction in electric resistance can be effectively achieved by shortening the distance between the drive electrode and the tip of the nozzle, or increasing a cross section of the fluid flow path in the fluid discharge head.

However, as in the case of an electrostatic suction type fluid discharge device of the present invention, in a fluid discharge head employing a nozzle with a micro diameter of 0.01 μm to 25 μm, it is difficult to dispose the drive electrode in the fluid flow path closer to the nozzle hole as the diameter of the nozzle decreases. Specifically, it becomes structurally difficult to coat an inner wall of the ink flow path with an electrode up to the vicinity of the nozzle, or to insert an electrode line to the ink flow path up to the vicinity of the nozzle.

According to the present invention, an electrostatic suction type fluid discharge device improves the discharge characteristic of the fluid discharge head having a micro nozzle, by coating an external wall of the nozzle with a conductive material and applying a drive voltage to a tip of the nozzle. That is, by supplying an electric charge to the discharge fluid at the tip of the nozzle, the electrostatic suction type fluid discharge device improves the discharge characteristic. The following first to fifth embodiments describe such an electrostatic suction type fluid discharge device.

First Embodiment

Figure 1:
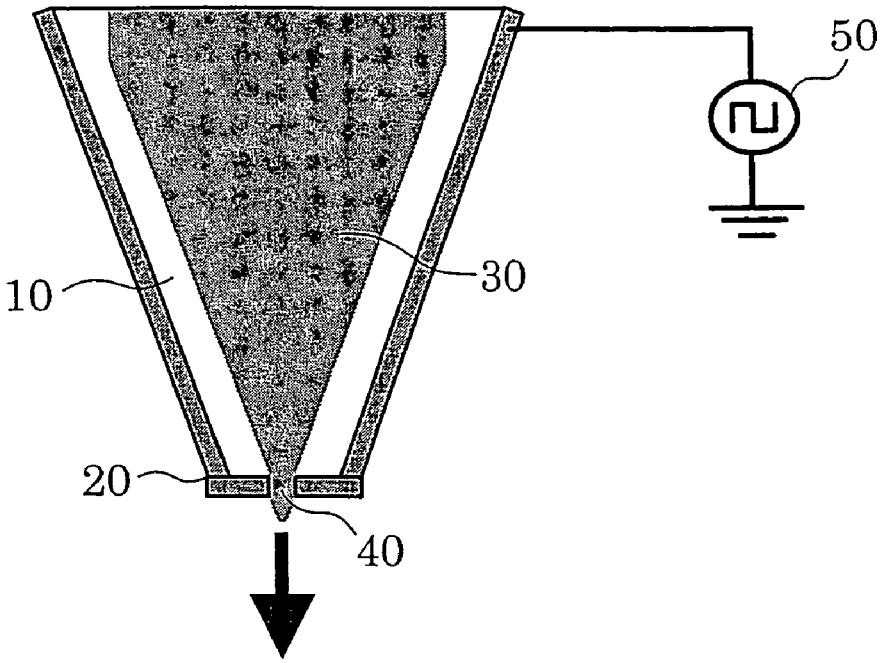
FIG. 1 is a cross-sectional view illustrating a structure of a nozzle of a fluid discharge head in an electrostatic suction type fluid discharge device according to the first embodiment of the present invention.

FIG. 1 illustrates a structure of an electrostatic suction type fluid discharge device of a first embodiment.

A nozzle of a fluid discharge head, illustrated in FIG. 1, includes a nozzle section 10 having a sharp tip, an electrode section 20, a fluid flow path 30, and a nozzle hole 40. The electrode section 20 is provided on an external wall of the nozzle section 10, and the fluid flow path 30 is provided inside the nozzle section 10. Further, the nozzle hole 40 is provided at an edge of the fluid flow path 30, i.e., at the tip of the nozzle. The electrode section 20 is connected to a power supply 50 for applying a drive voltage.

The nozzle section 10 is made of an insulating material, and a glass is particularly preferable because of its high formability. By deforming a grass tube by heat and stretching force, a nozzle hole having an internal diameter of approximately 1 μm is easily formed.

The electrode section 20 is made of a conductive material, and a low-resistance material is particularly preferable as it ensures adherence to the nozzle section 10. The electrode section 20 can be easily constructed by a common method, such as vacuum deposition, spattering, plating, or the like. The electrode section 20 shown in FIG. 1 constitutes at least a part of the internal wall of the nozzle hole 40, and is in touch with the fluid in the nozzle regardless of whether or not the fluid is being discharged.

During fabrication of the electrode section 20, the material may obstruct the nozzle hole 40. This may be avoided by appropriately positioning the nozzle, for example. In the case of fabrication method in which the obstruction of the nozzle hole 40 is unavoidable, the nozzle hole 40 is formed by laser beam machining or the like after the electrode section 20 is formed.

The following describes a fluid discharging mechanism in a fluid discharge head having the above nozzle. An arbitrary drive voltage is applied to the electrode section 20 from the power supply 50, so that an electric charge is supplied to a discharge fluid, which is in contact with the electrode section 20 at the tip of the nozzle. As a result, electric charge is accumulated in the tip of the nozzle, and an electric field intensity of the discharge fluid is increased. When the electric field intensity reaches a predetermined level, the discharge of fluid begins.

A discharge response time, from a point when the discharge fluid receives the electric charge to a point when the discharge starts, largely depends on the distance between the electrode section 20 and the nozzle hole 40. The shortest discharge response time is attained when the nozzle hole 40 fits into the electrode section 20 as illustrated in FIG. 1.

Table 1 shows a result of experiment of comparison in discharge limit frequency between a case (i) where an electrode is inserted into the fluid flow path and a case (ii) where an electrode is provided on the external wall through conductive coating. When the nozzle hole has a micro diameter, i.e., ϕ1.2 μm, the distance between the nozzle hole and the electrode is large, i.e., 680 μm even though the electrode is inserted into the flow path. This is due to a large difference between the diameter of the inserted electrode and the diameter of the nozzle hole. On the other hand, when the electrode is provided on the external wall of the nozzle through conductive coating, the electrode section is disposed in the vicinity of the nozzle hole. Thus, the formation of electrode on the external wall of the nozzle allows increase in discharge response, and the discharge limit frequency becomes 30 times greater compared to the structure in which the electrode is inserted into the flow path.

TABLE 1

| | ELECTRODE INSIDE FLOW PATH | CONDUCTIVE COATING ON EXTERNAL WALL |
|---|---|---|
| DISCHARGE LIMIT FREQUENCY | 83 HZ | 2.5 KHz |

NOZZLE HOLE: ϕ1.2 μM
DIAMETER OF INSERTED ELECTRODE: ϕ50 μM

Figure 7:
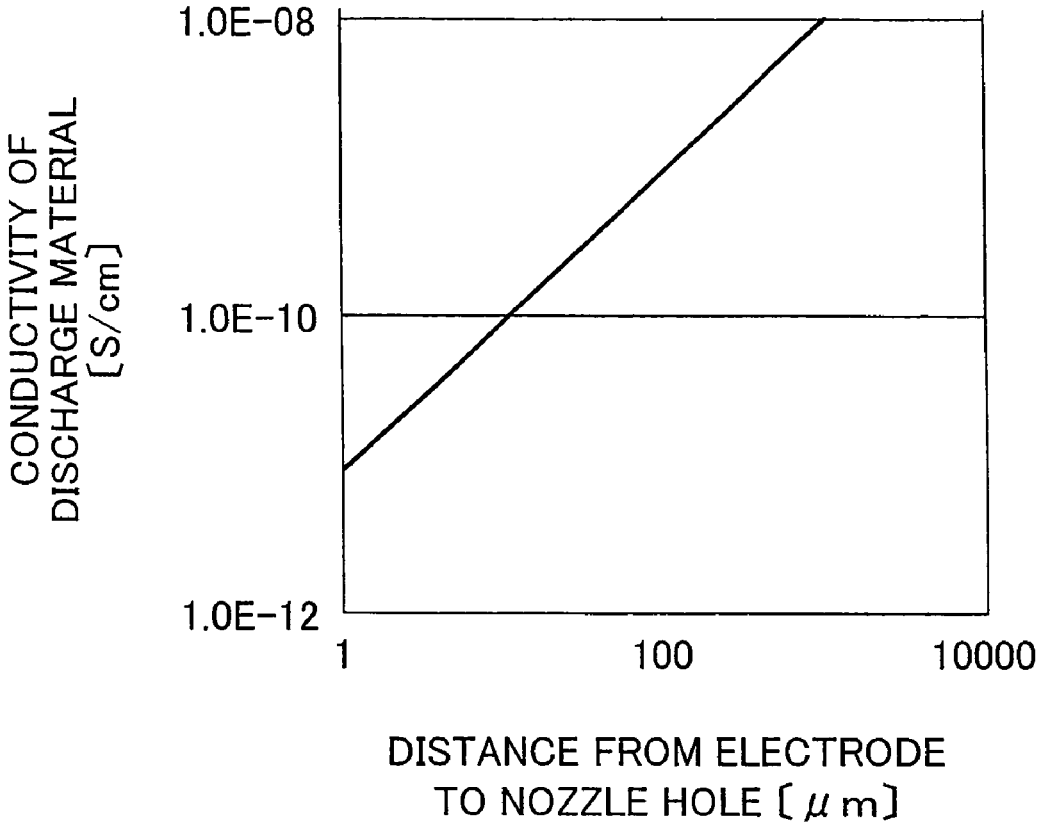
FIG. 7 is a graph showing a relationship between a distance from an electrode to a nozzle hole and a conductivity of a potential material of a discharge fluid in the electrostatic suction type fluid discharge device.

FIG. 7 represents a relationship between the distance from the electrode to the nozzle hole and a conductivity of a potential material of the discharge fluid. As shown in FIG. 7, the distance from the electrode to the nozzle hole and the conductivity of the discharge material basically have a linear relationship. Therefore, to discharge a high-resistance material, the electrode is required to be closer to the nozzle hole.

As described, in the electrostatic suction type fluid discharge device of the first embodiment, the electrode section 20 is formed by coating the external wall of the nozzle with a conductive material. This facilitates construction of a head in which the distance between the electrode section 20 and the nozzle hole 40 is minimally reduced, compared to the method of forming the electrode section inside the fluid flow path. That is, by disposing the electrode section 20 closer to the nozzle hole 40, it is possible to increase a drive frequency for causing discharge, and to use materials with higher resistance for the fluid to be discharged.

In the above description, the discharge fluid inside the fluid flow path 30 is in touch with the electrode section 20 regardless of whether or not the discharge is being executed, and an electric charge is supplied to the discharge fluid by applying a desirable drive voltage to the electrode section 20. However, actually, there is a case where the discharge fluid is drawn into an inner side of the fluid flow path 30 from the nozzle hole 40, and is not in contact with the electrode section 20.

In such a case, even by applying the drive voltage to the electrode section 20, the electric charge is not immediately supplied to the discharge fluid. However, the drive voltage applied to the electrode section 20 causes the discharge fluid inside the fluid flow path 30 to be drawn to the outside of the nozzle hole 40 due to an electro-wetting effect, and the discharge fluid comes in contact with the electrode section 20 and therefore is discharged from the nozzle. The electro-wetting effect is an effect of improving wettability of the discharge fluid due to an interaction of an electric field with a discharge fluid. That is, with the improvement in wettability of the discharge fluid due to the electro-wetting effect, the discharge fluid moves on the inner wall surface of the nozzle section 10 so that an area where the discharge fluid contacts the nozzle section 10 is enlarged. As a result, the discharge fluid seeps from the nozzle hole 40.

Though the nozzle has a sharp tip in the above embodiment, the nozzle may have a flat opened end.

According to the structure illustrated in FIG. 1, at the tip of the nozzle of the fluid discharge head, the electrode section 20 constitutes at least a part of the inner wall of the nozzle hole 40. Therefore, the electrode section 20 is in touch with the fluid inside the nozzle regardless of whether or not the fluid is being discharged.

Figure 8:
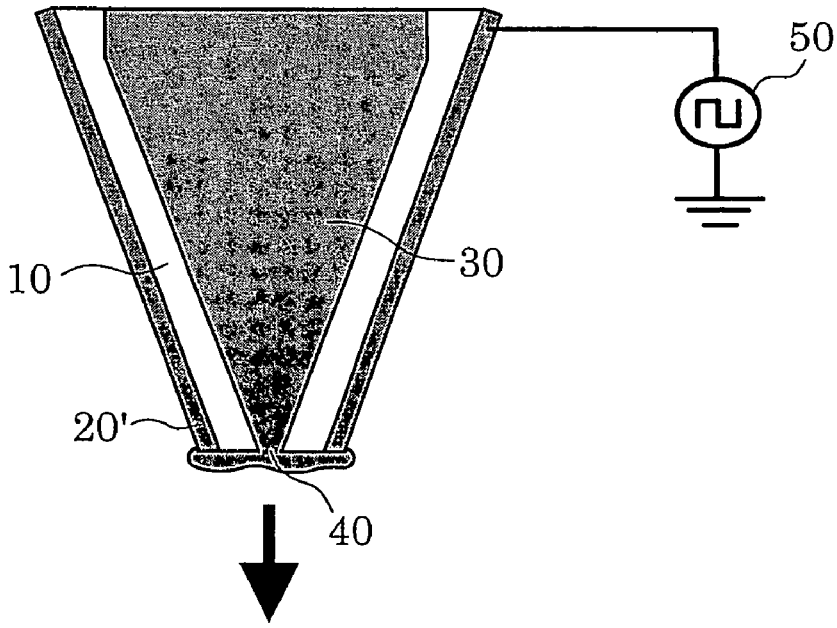
FIG. 8 is a cross-sectional view illustrating a modification example of the nozzle of the fluid discharge head in the electrostatic suction type fluid discharge device of the first embodiment.

However, as illustrated in FIG. 8, the present invention also includes a case where the electrode section 20 is not a part of the inner wall of the nozzle hole 40. In this case, the electrode section 20 is not brought into contact with the discharge fluid inside the nozzle until the discharge is executed (until the drive voltage is applied to the electrode section 20). When the drive voltage is applied to the electrode section 20, the discharge fluid inside the fluid flow path 30 seeps through the nozzle hole 40 due to the electro-wetting effect and comes in contact with the electrode section 20, as illustrated in FIG. 8.

According to the structure illustrated in FIG. 8, the electrode section 20 does not constitute the inner surface of the nozzle hole 40. Therefore, when the electrode section 20 is formed, the nozzle hole 40 will not be obstructed by a material of the electrode section 20. This advantageously facilitates formation of the electrode section 20. However, in the structure illustrated in FIG. 8, the nozzle needs to have a sharp tip, and also the nozzle hole 40 and the electrode section 20 need to be sufficiently close to each other.

Second Embodiment

Figure 9:
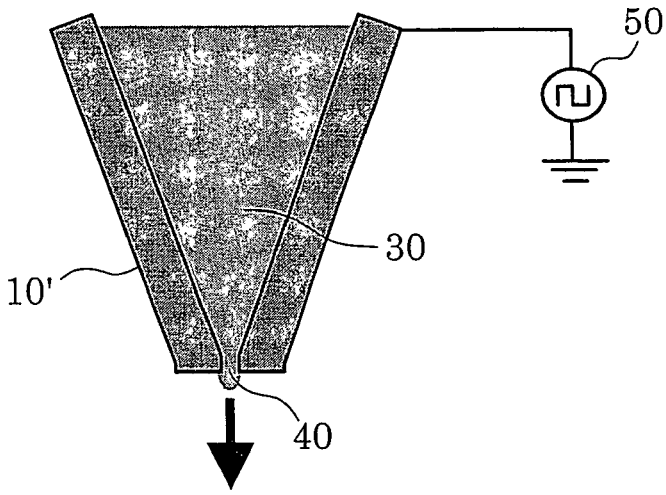
FIG. 9 is a cross-sectional view illustrating a structure of a nozzle of a fluid discharge head in an electrostatic suction type fluid discharge device according to the second embodiment of the present invention.

FIG. 9 illustrates a structure of a nozzle of a fluid discharge head in an electrostatic suction type fluid discharge device of a second embodiment. In the second embodiment, differences from the first embodiment are described and explanations for parts being the same as those described in the first embodiment are omitted. The nozzle section 10 in the first embodiment is made of an insulating material, while a nozzle section in the second embodiment is made of a conductive material.

That is, in the structure illustrated in FIG. 9, a nozzle section 10' serves as an electrode section and is connected to a power supply 50. The nozzle section 10' may be made of a conductive material such as a metal material including aluminum, nickel, copper, silicon, or the like, or a conductive polymeric material. As to the micro hole forming process for creating a nozzle hole 40 on the tip of the nozzle section 10', applicable methods are reactive ion etching (RIE), a laser process, photo assisting electrolytic chemical etching, or the like.

The following describes a fluid discharging mechanism of a fluid discharge head incorporating the foregoing nozzle. In the nozzle having the above structure, an arbitrary voltage is applied to the entire nozzle section 10' from the power supply 50, not only charging the fluid in the vicinity of the nozzle hole 40 which is discharged at the beginning of discharge, but also charging the fluid inside the fluid flow path 30 away from the nozzle hole 40. This improves both the discharge response and the durability of electric charge during consecutive discharge, i.e. the stability of consecutive discharge.

As described above, in the electrostatic suction type fluid discharge device of the second embodiment, the entire tip of the nozzle is made of a conductive material. This improves the discharge response; thereby improving the drive frequency, enlarges the selection range of material of discharge fluid, and improves the stability in consecutive discharge.

Third Embodiment

Figure 10:
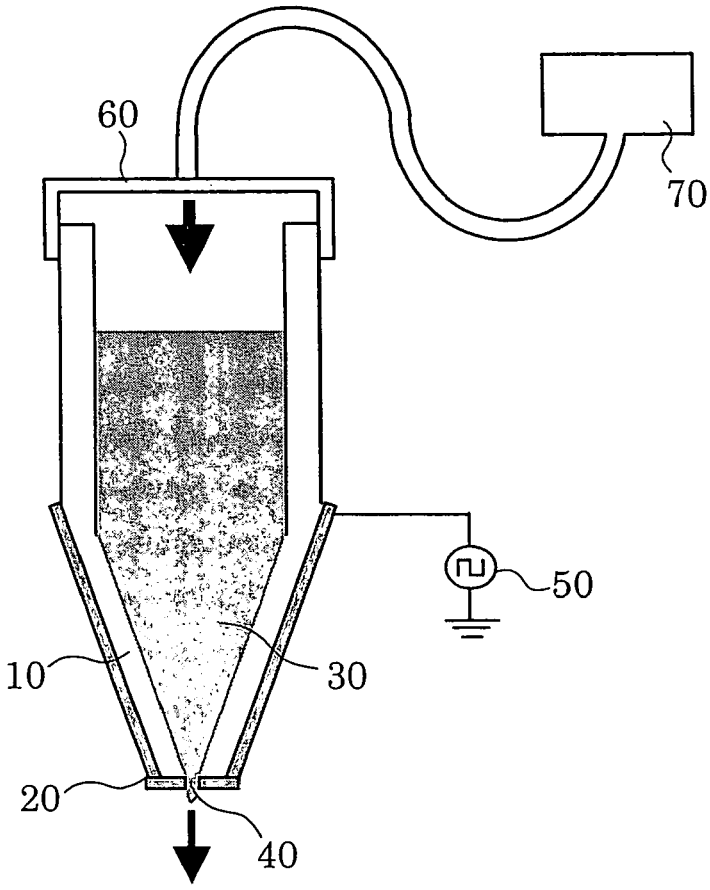
FIG. 10 is a cross-sectional view illustrating a structure of a nozzle of a fluid discharge head in an electrostatic suction type fluid discharge device according to the third embodiment of the present invention.

FIG. 10 illustrates a schematic structure of an electrostatic suction type fluid discharge device of a third embodiment. In the third embodiment, differences from the first and second embodiments are described, and explanations for parts being the same as those described in the first and second embodiments are omitted.

In a fluid discharge head of the third embodiment, a pressure control mechanism is provided in the nozzle section 10. The pressure control mechanism is positioned in an upper stream portion in terms of discharge flow, and is connected to a pressure control device 70 through a joint section 60.

Described next is a fluid discharge mechanism of the fluid discharge head. Because of the presence of the pressure control device 70, an external pressure is applied to a discharge fluid inside the fluid flow path 30 regardless of whether or not the discharge is being executed. The external pressure causes the discharge fluid to be guided to the outside of a nozzle hole 40. Such guiding pressure offered by the pressure control device 70 depends on a diameter of the nozzle hole, a viscosity of the discharge fluid, or the like. However, when the nozzle hole 40 has a diameter of $\phi 1$ μm for example, it is possible to guide the discharge fluid to the outside of the nozzle hole 40 under a pressure ranging from 0.3 MPa to 0.6 MPa.

The guiding pressure causes the discharge fluid passing through the micro nozzle hole 40 to be in contact with an electrode section 20. Therefore, during the fluid discharging operation, the discharge fluid is charged by the electrode section 20 at the same timing of voltage application to the electrode section 20. The fluid thus charged is discharged by an electric field force exerted on at the tip of the nozzle.

As described above, in the electrostatic suction type fluid discharge device of the third embodiment, the pressure applied to the discharge fluid from the upstream side of the discharge section keeps the discharge fluid to be guided to the nozzle hole, making the fluid to be constantly in contact with the electrode section, thereby realizing stable discharge.

In FIG. 10, the pressure control device 70 is combined with the nozzle shown in FIG. 1, but it may be combined with the nozzle shown in FIG. 8.

Fourth Embodiment

Figure 11:
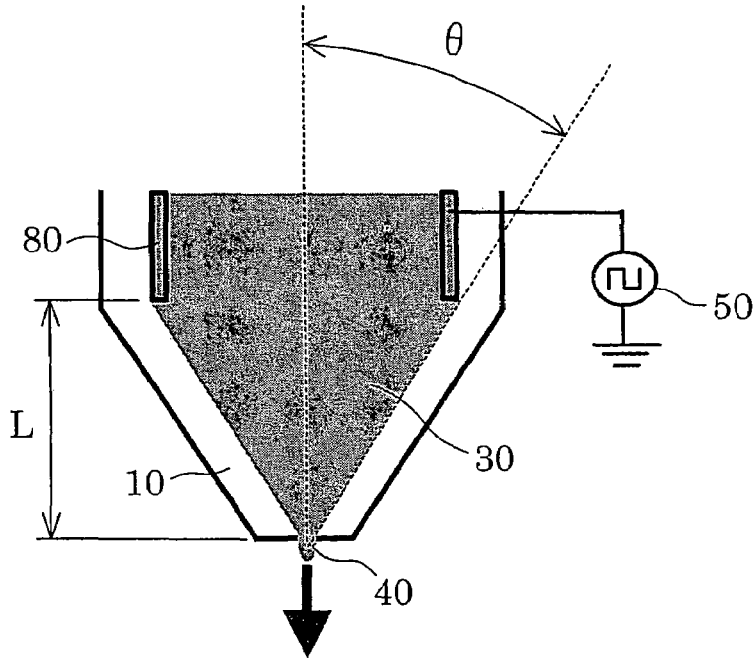
FIG. 11 is a cross-sectional view illustrating a structure of a nozzle of a fluid discharge head in an electrostatic suction type fluid discharge device according to the fourth embodiment of the present invention.

FIG. 11 illustrates a schematic structure of a fluid discharge head in an electrostatic suction type fluid discharge device of a fourth embodiment.

In the fourth embodiment, the fluid discharge head of the electrostatic suction type fluid discharge device is provided with a drive electrode section 80 inside a fluid flow path 30. With this structure, by appropriately setting a taper angle of the internal flow path 30, in the tip of a nozzle section 10, it is possible to improve the discharge limit frequency, and to use materials with higher resistance for the fluid to be discharged.

As described above, in the electrostatic suction type fluid discharge device, the discharge characteristic depends on an electric resistance of a discharge fluid which exists between a drive electrode 20 and a nozzle hole 40.

Figure 12:
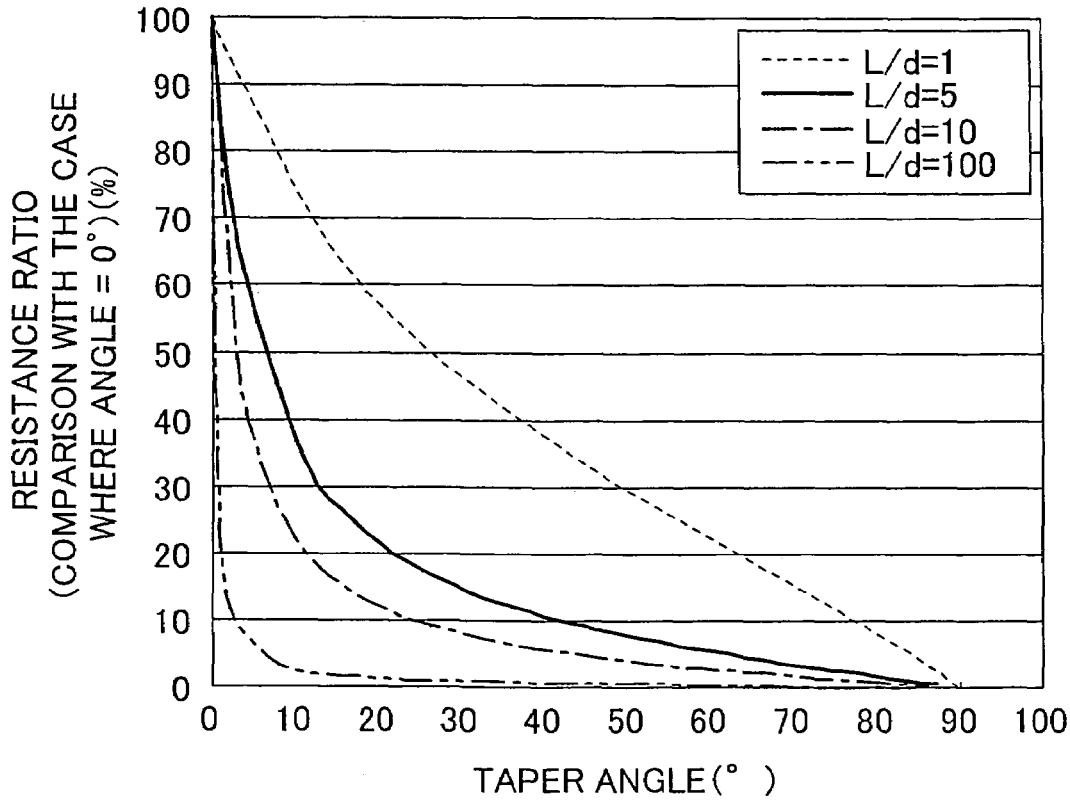
FIG. 12 is a graph showing a relationship between taper angle and resistance ratio in the electrostatic suction type fluid discharge device of the fourth embodiment.

For the parameters for defining the electric resistance inside the fluid flow path 30, a length and cross-sectional area of the fluid flow path 30, and a conductivity of the discharge fluid may be used. Assuming that a taper angle θ, formed by the length and the cross-sectional area of the flow path, is used as a parameter. FIG. 12 shows a relationship between the taper angle θ and the electric resistance (resistance ratio). The resistance ratio in FIG. 12 denotes an electric resistance inside the fluid flow path 30 for each value of taper angle with respect to angle 0°.

In FIG. 12, a ratio between a taper length L and a nozzle diameter d, i.e., L/d, is used as a parameter, and respective relationships between the taper angle and the resistance ratio in the cases where L/d is 1, 5, 10, and 100 are plotted. As illustrated in FIG. 11, the taper length L denotes a length of taper section in the nozzle section 10 along the fluid-discharging direction.

In actual manufacturing of micro nozzle having a diameter of 25 μm or below, the relationship L/d is generally in a range from 5 to 100. Since the range of taper length L is specified regardless of the nozzle diameter d, a value of the L/d tends to increase as the nozzle diameter decreases, that is, it tends to decrease as the nozzle diameter increases.

With reference to FIG. 12, it is understood that the resistance ratio decreases as the taper angle θ increases no matter what value the L/d takes. With the taper angle θ of 21° or greater, the resistance ratio becomes 20% or less when the L/d takes a value of 5 or greater.

As described above, in the electrostatic suction type fluid discharge device of the fourth embodiment, the electric resistance between the electrode section 80 and the nozzle hole 40 is significantly suppressed by setting the taper angle θ to 21° or greater relative to the inner wall of the nozzle section 10. This improves a discharge limit frequency. Further, it allows use of materials with higher resistance for the fluid to be discharged.

Figure 13:
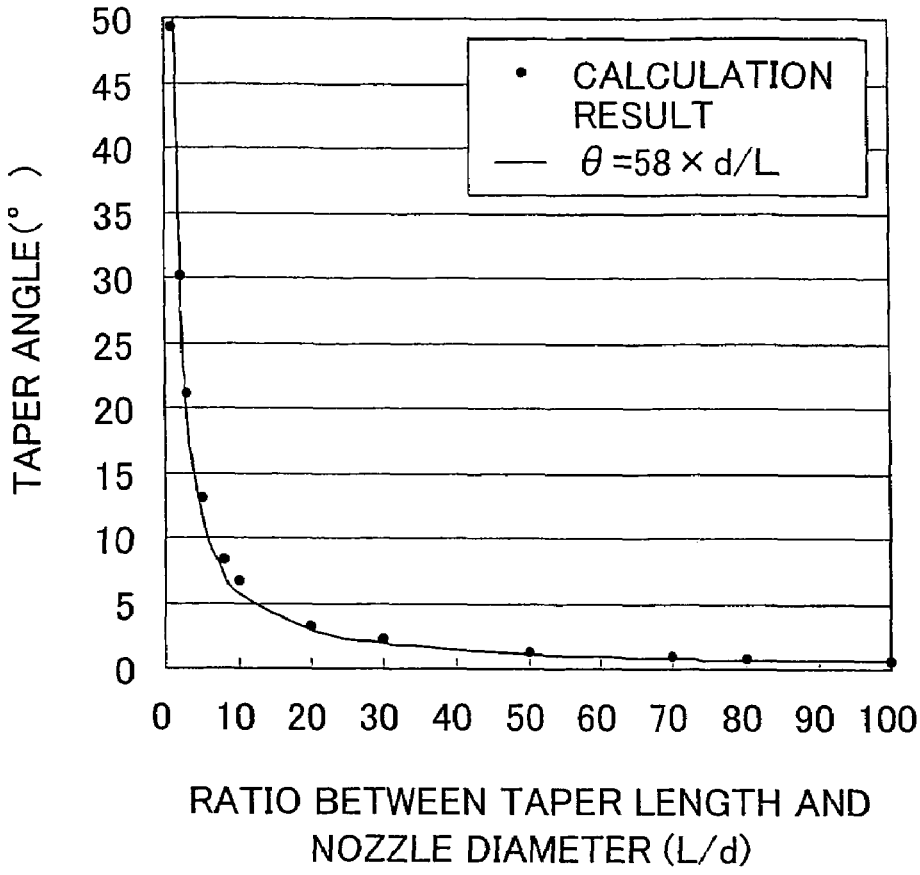
FIG. 13 is a graph showing a relationship between the ratio of taper length to nozzle diameter, (L/d) and a taper angle θ in the electrostatic suction type fluid discharge device of the fourth embodiment.

Further, FIG. 13 represents a relationship between (i) the ratio of taper length to nozzle diameter (L/d) and (ii) the taper angle θ, provided that the resistance ratio is 30%. According to FIG. 13, the following relationship is given when the resistance ratio is 30%:

$$\theta=58/(L/d).$$

Based on this equation, the resistance ratio of 30% or less is obtained by satisfying the following relationship, $$\theta>58\times d/L.$$

Fifth Embodiment

Figure 14:
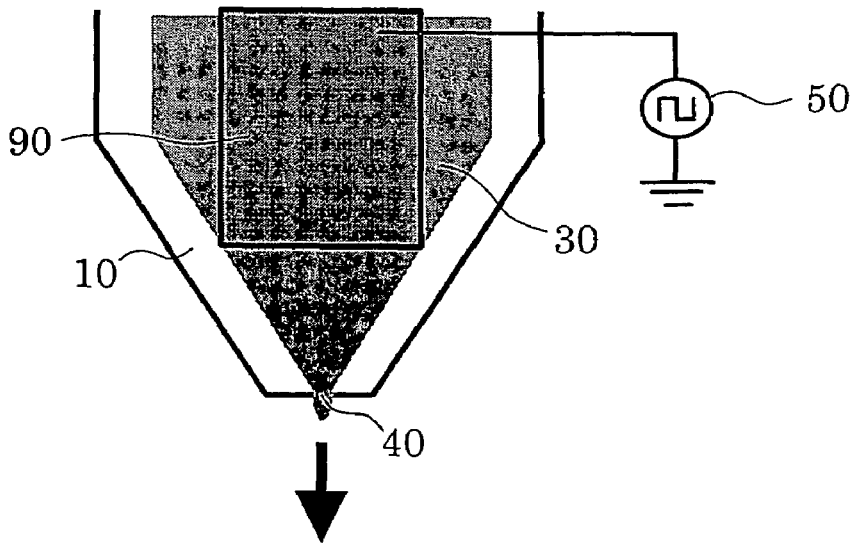
FIG. 14 is a cross-sectional view illustrating a structure of the nozzle of a fluid discharge head in an electrostatic suction type fluid discharge device according to the fifth embodiment of the present invention.
Figure 15:
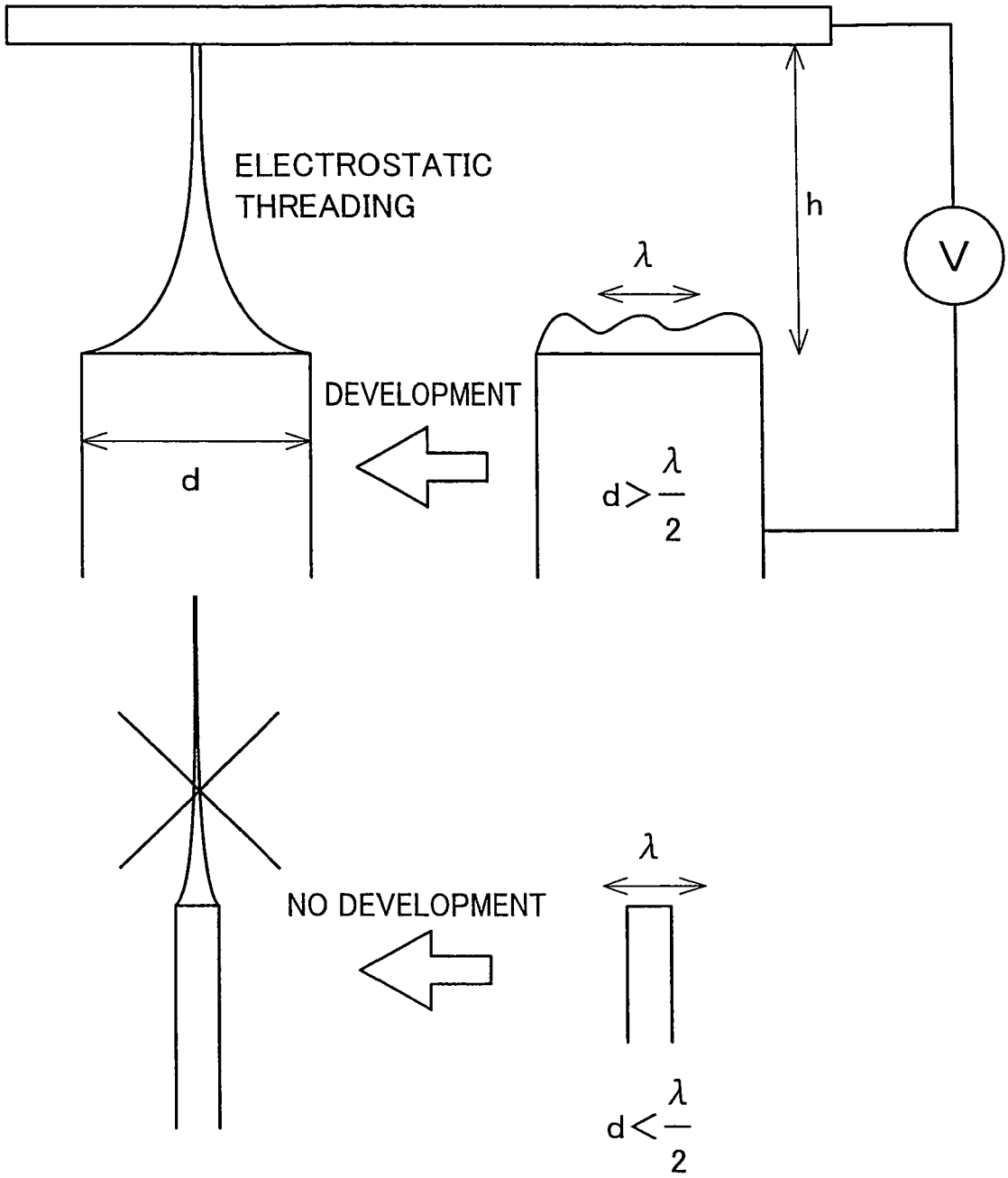
FIG. 15 is a drawing illustrating the principle of the development of a discharged fluid on account of electrostatic thread-forming phenomenon, in the electrostatic suction type fluid discharge device.

FIG. 14 illustrates a schematic structure of a fluid protruding head in an electrostatic suction type fluid discharge device of a fifth embodiment. In the fifth embodiment, differences from the first and fourth embodiments are described, and explanations for parts being the same as those described in the first and fourth embodiments are omitted.

In the electrostatic suction type fluid discharge device of the fifth embodiment, an electrode section 90, which is formed as a bar, is inserted into a fluid flow path 30 inside a nozzle section 10. Further, the electrode section 90 is provided at three or more locations on an inner wall of a taper. With the above structure, an electric resistance of discharge fluid in the path between the electrode section 90 and the nozzle hole 40 is reduced because the electrode section 90 is brought to the closest point to the nozzle hole 40 within a permissible range. This improves a discharge limit frequency. Further, it allows use of materials with higher resistance for the fluid to be discharged.

Note that, when the electrode section 90 is brought to the closest point to the nozzle hole 40 within a permissible range in the structure described above, it is required that a cross-sectional shape of the electrode section 90 is not completely identical to a cross section of an inner wall of the taper.

INDUSTRIAL APPLICABILITY

The electrostatic suction type fluid discharge device of present invention is useful for an inkjet printer or the like.

The invention claimed is:

1. An electrostatic suction type fluid discharge device which discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the electrostatic suction type fluid discharge device comprising an electrode section provided inside the nozzle, the electrode section for carrying out application of a driving voltage, causing an electric charge to be supplied to the discharge fluid, so as to charge the discharge fluid, an inner wall of a tip of the nozzle has a taper section with a taper angle θ of 21° or greater, provided that $L/d>5$, where L is a taper length and d is a nozzle diameter, wherein the electrode section is formed as a bar inserted into the nozzle and a tip of the electrode section is in contact with the inner wall of the taper section.

2. An electrostatic suction type fluid discharge device which discharges by electrostatic suction a discharge fluid, which is electrically charged by voltage application, onto a substrate through a fluid discharge hole of a nozzle of a fluid discharge head, so as to form a drawing pattern on a surface of the substrate, the fluid discharge hole, provided in the nozzle, having a diameter ranging from 0.01 μm to 25 μm, the electrostatic suction type fluid discharge device comprising an electrode section provided inside the nozzle, the electrode section for carrying out application of a driving voltage, causing an electric charge to be supplied to the discharge fluid, so as to charge the discharge fluid, an inner wall of a tip of the nozzle having a taper section with a taper angle θ satisfying a condition: $\theta>58\times d/L$, where L is a taper length and d is a nozzle diameter, provided that $L/d<100$, wherein the electrode section is formed as a bar inserted into the nozzle and a tip of the electrode section is in contact with the inner wall of the taper section.

* * * * *